US007704338B2

(12) United States Patent
Tanida

(10) Patent No.: US 7,704,338 B2
(45) Date of Patent: Apr. 27, 2010

(54) METHOD OF MANUFACTURING A MARTENSITIC STAINLESS STEEL

(75) Inventor: Mutsumi Tanida, Wakayama (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 714 days.

(21) Appl. No.: 10/942,132

(22) Filed: Sep. 16, 2004

(65) Prior Publication Data

US 2005/0034796 A1 Feb. 17, 2005

Related U.S. Application Data

(63) Continuation of application No. PCT/JP03/04671, filed on Apr. 11, 2003.

(30) Foreign Application Priority Data

Apr. 12, 2002 (JP) ..... 2002-110495

(51) Int. Cl.
*C21D 6/00* (2006.01)

(52) U.S. Cl. ..... 148/605; 148/579; 148/660; 148/663; 420/68; 420/70

(58) Field of Classification Search ..... 148/579, 148/605

See application file for complete search history.

(56) References Cited

U.S. PATENT DOCUMENTS 3,658,514 A 4/1972 Lula et al.
5,383,983 A * 1/1995 Kondo et al. ..... 148/325
5,601,411 A * 2/1997 Usami et al. ..... 416/241 R

FOREIGN PATENT DOCUMENTS

EP 0286675 10/1988

(Continued)

OTHER PUBLICATIONS

John W. Smith, "Types of Heat-Treating Furnaces," ASM Handbook, vol. 4, pp. 465-474, 1995.*

(Continued)

*Primary Examiner*—Roy King
*Assistant Examiner*—Christopher Kessler
(74) *Attorney, Agent, or Firm*—Clark & Brody

(57) ABSTRACT

This invention relates to a method of manufacturing a martensitic stainless steel.

The method comprises the following steps (a) to (c):

(a) preparing a steel having a chemical composition consisting of, by mass %, C: 0.003 to 0.050%, Si: 0.05 to 1.00%, Mn: 0.10 to 1.50%, Cr: 10.5 to 14.0%, Ni: 1.5 to 7.0%, V: 0.02 to 0.20%, N: 0.003 to 0.070%, Ti: not more than 0.300% and the balance Fe and impurities, and P and S among impurities are not more than 0.035% and not more than 0.010% respectively, and that it also satisfies the following equation:

$$([Ti]-3.4\times[N])/[C]>4.5$$

wherein [C], [N] and [Ti] mean the content (mass %) of C, N and Ti, respectively, (b) heating the steel at a temperature between 850 and 950° C., (c) quenching the steel, and (d) tempering the steel at a temperature between Ac1−35° C. and Ac1+35° C. and in a condition of not more than 0.5 of the value of variation ΔLMP1 in the softening characteristics LMP1, which is defined by the following equation:

$$LMP1=T\times(20+1.7\times\log(t))\times10^{-3}$$

wherein T is a tempering temperature (K), and t is a tempering time (hour).

The steel could further contain 0.2 to 0.3 % of Mo.

2 Claims, 4 Drawing Sheets

FOREIGN PATENT DOCUMENTS

| | | | |
|---|---|---|---|
| EP | 0565117 | | 10/1993 |
| EP | 649 915 | A1 | 4/1995 |
| JP | 07-041909 | | 2/1995 |
| JP | 08-260050 | | 10/1996 |
| JP | 2000-144337 | | 5/2000 |
| JP | 2000-160300 | | 6/2000 |
| JP | 2000-178692 | | 6/2000 |
| JP | 2001-26820 | | 1/2001 |
| JP | 2002-30392 | | 1/2002 |
| RU | 2136774 | | 9/1999 |
| RU | 2176674 | | 12/2001 |
| SU | 1046323 | | 10/1983 |

OTHER PUBLICATIONS

Michael Wisti and Mandar Hingwe, "Tempering of Steel," ASM Handbook, vol. 4, 1991, pp. 121-136.*

* cited by examiner

METHOD OF MANUFACTURING A MARTENSITIC STAINLESS STEEL

This application is a continuation of International Patent Application No. PCT/JP03/04671, filed Apr. 11, 2003, and claims priority to Japanese application 2002-110495 filed Apr. 12, 2002. This PCT application was not in English as published under PCT Article 21(2).

TECHNICAL FIELD

The present invention relates to a method of manufacturing a martensitic stainless steel, and more specifically relates to a method of manufacturing a martensitic stainless steel capable of suppressing the variation in yield strength to as little as possible.

TECHNICAL BACKGROUND

A martensitic stainless steel that is excellent in the mechanical strengths such as a yield strength, a tensile strength and a toughness is also excellent in corrosion resistance and heat resistance. Among the martensitic stainless steels, a martensitic stainless steel containing about 13% Cr, such as 420 steel in AISI (American Iron and Steel Institute), is excellent in corrosion resistance especially under an environment exposed to carbon dioxide gas. The martensitic stainless steel containing about 13% Cr is generally called as "13% Cr steel".

However, this 13% Cr steel has a lower maximum temperature that is applicable for practical use. Therefore, exceeding the lower maximum temperature gives a less corrosion resistance, which may result in restricting the applicable field of use of this 13% Cr steel.

In this context, another martensitic stainless steel has been improved by adding an Ni element to the 13% Cr steel. This improved martensitic stainless steel is generally called as "super 13Cr steel". The improved martensitic stainless steel has not only higher mechanical strength such as a yield strength, but also better corrosion resistance for hydrogen sulfide, as compared with the 13% Cr steel. Then, this super 13Cr steel is particularly suitable for an oil well tube in an environment containing a hydrogen sulfide.

In manufacturing the improved martensitic stainless steel, a method has been adopted in order to induce a martensite transformation during quenching the steel from a temperature of not less than the $A_{C3}$ point, followed by tempering. Excessive high mechanical strength is not preferable because higher mechanical strength steel is more susceptible for a sulfide stress cracking. The quenching leads to a martensite structured steel having an excessively high strength, but the subsequent tempering adjusts it to a structured steel that has the desired mechanical strength.

Several methods of manufacturing a martensitic stainless steel in which tempering process was improved to adjust mechanical strength are disclosed as described below.

Japanese Patent Unexamined Publication Nos. 2000-160300 and 2000-178692 disclose a method of manufacturing a high Cr alloy with a low carbon for oil well tube, which has an improved corrosion resistance or stress corrosion cracking resistance with 655 N/mm$^2$ (655 MPa) grade yield strength. The method is as follows: heat treatment of austenitizing, cooling, first tempering at a temperature not less than $A_{C1}$ point and not more than $A_{C3}$ point, cooling, and second tempering at a temperature that is not less than 550° C. and not more than $A_{C1}$ point.

Also, Japanese Patent Unexamined Publication No. H08-260050 discloses a method of manufacturing a martensitic stainless steel seamless steel tube, in which a steel is tempered at a temperature that is not less than $A_{C1}$ point and not more than $A_{C3}$ point, and then cooled in order to perform a cold working so that the steel is adjusted to have a desired yield stress.

DISCLOSURE OF THE INVENTION

A steel used for an oil well tube is required to be tempered in order to have a yield strength within a range which is not less than a certain lower limit that is respectively selected within the values of 552 to 759 MPa (80 to 110 ksi) according to each grade of the API standard, and also which is not more than an upper limit that is calculated by adding 103 MPa to the lower limit. Hereinafter, this requirement is referred to as "API strength specification".

However, such a martensitic stainless steel as super 13Cr steel that contains Ni, has a lower $A_{C1}$ point than a martensitic stainless steel such as 13% Cr steel that does not contain Ni, which might lead to an insufficient tempering. Therefore, the super 13Cr steel must be tempered at a temperature of the vicinity of the $A_{C1}$ point or over the $A_{C1}$ point. As a result, the tempered steel comprises a tempered martensite structure and a retained austenite one, so that the fluctuation of an amount of the retained austenite causes a variation in the yield strength after tempering.

Further, a large variation of the C content of a steel material causes a variation in the amount of carbide such as VC generated in tempering, which causes a variation in a yield strength of a steel material. Although the variation in C content between the respective steel materials is preferably within 0.005%, it is industrially difficult to suppress such a variation.

Here, the variation means a property variation in the mechanical strength such as a yield strength, and the variation in the chemical compositions such as ingredient contents, when compared to a plurality of steel materials or steel products of martensitic stainless steels. Even if the martensitic stainless steels are manufactured from steels of the same compositions and in the same process, the variation in a yield strength is inevitably generated by an change in the microstructure during tempering. To provide users with steel products of high reliability, it is preferable that the variation in a yield strength of the products be smaller.

The above-mentioned publications describe the methods of manufacturing steel tubes with a desired mechanical strength. However, no publications refer to a variation in a yield strength. In any methods disclosed above of manufacturing steel tubes through complicated manufacturing steps, it is assumed that controlling the manufacturing conditions so as to keep a yield strength within a certain range is difficult, which might result in a large variation in the yield strength.

The objective of the present invention is to solve the above-mentioned problems and specifically to provide a method of manufacturing a martensitic stainless steel having a small variation in a yield strength by controlling chemical compositions, quenching conditions and tempering conditions of the steel material.

The present inventor has first studied a relationship between a tempering temperature of a martensitic stainless steel and a yield strength. There is a constant relationship between the yield strength and the tempering temperature of martensitic stainless steel. This relationship is shown by the temper-softening curve. This temper-softening curve is a curve showing a yield strength of steel when tempered at optional temperatures. The tempering temperature can be determined on the basis of the temper-softening curve. In a case of a martensitic stainless steel containing Ni according to the present invention, the temper-softening curve is steep.

FIG. 1 is a graph schematically showing one example of a temper-softening curve. As shown in the graph, a temper-softening curve of an Ni-containing martensitic stainless steel is steeper in the vicinity of the $A_{C1}$ point, compared with the temper-softening curve of an Ni-free martensitic stainless steel. Therefore, in manufacturing a martensitic stainless steel within the range of the yield strength that is allowable in the API strength specification, with respect to a certain target yield strength, the selectable range of the tempering temperature in the Ni-containing martensitic stainless steel becomes narrower than in the Ni-free martensitic stainless steel.

The narrow range of the tempering temperature cannot correspond with the fluctuation of a furnace temperature in tempering, it makes it difficult to produce a martensitic stainless steel that satisfies the API strength specification because of the increased variation in the yield strength of the martensitic stainless steel. Thus, if a steep change in the temper-softening curve is suppressed, the variation in a yield strength can be suppressed.

Further, a Ni-containing martensitic stainless steel, as described above, must be performed to temper at a temperature of the vicinity of $A_{C1}$ or over $A_{C1}$ point, which causes not only the softening of martensite by tempering, but also softening by austenite transformation occur. The austenite transformation is significantly influenced by the holding time during tempering. Accordingly, the holding time must be also controlled.

In actual operation, variations of tempering conditions may occur such as a fluctuation in furnace temperature during tempering and a longer period of time in the furnace, which is caused by a difference in elapsing time between the tempering step and the subsequent step. If such variation can be suppressed, it is possible to suppress the variation in the yield strength.

The present invention is an invention that is a method of suppressing the variation in a yield strength of martensitic stainless steel by severely controlling the improvement of inclination of the temper-softening curve and tempering conditions. The following items (1) to (3) are methods of manufacturing martensitic stainless steels according to the present invention.

(1) A method of manufacturing a martensitic stainless steel characterized by comprising the following steps (a) to (d):

(a) preparing a steel having a chemical composition consisting essentially of, by mass %, C: 0.003 to 0.050%, Si: 0.05 to 1.00%, Mn: 0.10 to 1.50%, Cr: 10.5 to 14.0%, Ni: 1.5 to 7.0%, V: 0.02 to 0.20%, N: 0.003 to 0.070%, Ti: not more than 0.300% and the balance Fe and impurities, and P and S among impurities are not more than 0.035% and not more than 0.010% respectively, and that it also satisfies the following equation:

$$([Ti]-3.4\times[N])/[C]>4.5$$

wherein [C], [N] and [Ti] mean the content (mass %) of C, N and Ti, respectively, (b) heating the steel at a temperature between 850 and 950° C., (c) quenching the steel, and (d) tempering the steel in a walking beam furnace at a temperature between Ac1−35° C. and Ac1+35° C. and in a condition that the value of variation ΔLMP1 of the softening characteristics LMP1 is not more than 0.5, wherein LMP1 is defined by the following equation:

$$LMP1=T\times(20+1.7\times\log(t))\times10^{-3}$$

wherein T is a tempering temperature (K), and t is a tempering time (hour).

(2) A method of manufacturing a martensitic stainless steel characterized by comprising the following steps (a) to (d):

(a) preparing a steel having a chemical composition consisting essentially of, by mass %, C: 0.003 to 0.050%, Si: 0.05 to 1.00%, Mn: 0.10 to 1.50%, Cr: 10.5 to 14.0%, Ni: 1.5 to 7.0%, V: 0.02 to 0.20%, N: 0.003 to 0.070%, Zr: not more than 0.580% and the balance Fe and impurities, and P and S among impurities are not more than 0.035% and not more than 0.010% respectively, and that it also satisfies the following equation:

$$([Zr]-6.5\times[N])/[C]>9.0$$

wherein [C], [N] and [Zr] mean the content (mass %) of C, N and Zr, respectively, (b) heating the steel at a temperature between 850 and 950° C., (c) quenching the steel, and (d) tempering the steel in a walking beam furnace at a temperature between Ac1−35° C. and Ac1+35° C. and in a condition that the value of variation ΔLMP1 of the softening characteristics LMP1 is not more than 0.5, wherein LMP1 is defined by the following equation:

$$LMP1=T\times(20+1.7\times\log(t))\times10^{-3}$$

wherein T is a tempering temperature (K), and t is a tempering time (hour).

(3) A method of manufacturing a martensitic stainless steel characterized by comprising the following steps (a) to (d):

(a) preparing a steel having a chemical composition consisting essentially of, by mass %, C: 0.003 to 0.050%, Si: 0.05 to 1.00%, Mn: 0.10 to 1.50%, Cr: 10.5 to 14.0%, Ni: 1.5 to 7.0%, V: 0.02 to 0.20%, N: 0.003 to 0.070%, Ti: not more than 0.300%, Zr: not more than 0.580% and the balance Fe and impurities, and P and S among impurities are not more than 0.035% and not more than 0.010% respectively, and that it also satisfies the following equation:

$$([Ti]+0.52\times[Zr]-3.4\times[N])/[C]>4.5$$

wherein [C], [N] [Ti], and [Zr] mean the content (mass %) of C, N, Ti and Zr, respectively, (b) heating the steel at a temperature between 850 and 950° C., (c) quenching the steel, and (d) tempering the steel in a walking beam furnace at a temperature between Ac1−35° C. and Ac1+35° C. and in a condition that the value of variation ΔLMP1 of the softening characteristics LMP1 is not more than 0.5, wherein LMP1 is defined by the following equation:

$$LMP1=T\times(20+1.7\times\log(t))\times10^{-3}$$

wherein T is a tempering temperature (K), and t is a tempering time (hour).

(3) A method of manufacturing a martensitic stainless steel characterized by comprising the following steps (a) to (c):

(a) preparing a steel having a chemical composition consisting of, by mass %, C: 0.003 to 0.050%, Si: 0.05 to 1.00%, Mn: 0.10 to 1.50%, Cr: 10.5 to 14.0%, Ni: 1.5 to 7.0%, V: 0.02 to 0.20%, N: 0.003 to 0.070%, Ti: not more than 0.300%, Zr: not more than 0.580% and the balance Fe and impurities, and P and S among impurities are not more than 0.035% and not more than 0.010% respectively, and that it also satisfies the following equation:

$$([Ti]+0.52\times[Zr]-3.4\times[N])/[C]>4.5$$

wherein [C], [N] [Ti], and [Zr] mean the content (mass %) of C, N, Ti and Zr, respectively, (b) heating the steel at a temperature between 850 and 950° C., (c) quenching the steel, and (d) tempering the steel at a temperature between Ac1−35° C. and Ac1+35° C. and in a condition of not more than 0.5 of the value of variation ΔLMP1 in the softening characteristics LMP1, which is defined by the following equation:

$$LMP1=T\times(20+1.7\times\log(t))\times10^{-3}$$

wherein T is a tempering temperature (K), and t is a tempering time (hour).

Also, it is preferable that the martensitic stainless steel according to any one of above, further contains 0.2 to 3.0 mass % of Mo.

BEST MODE FOR CARRYING OUT THE INVENTION

Figure 1:
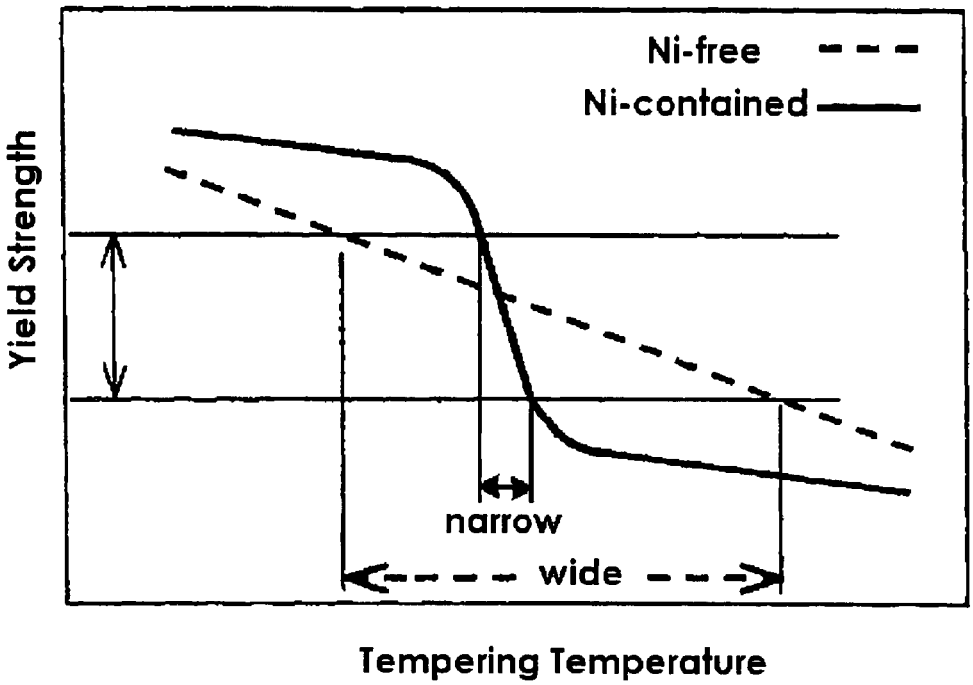
Fig. 1 PRIOR ART
FIG. 1 is a graph schematically showing one example of temper-softening curve.

A martensitic stainless steel, manufactured by the method according to the present invention, may have any shape such as sheet, tube and bar. In a method of manufacturing a martensitic stainless steel according to the present invention, (1) a chemical composition of a steel material, (2) quenching, and (3) tempering will be described in detail below. It is noted that "%" in content of an ingredient means "mass %".

(1) Chemical Composition of Steel Material

A chemical composition of a steel material influences the inclination of the temper-softening curve and other properties. Particularly, C, V, Ti and Zr have a large influence on the inclination of the temper-softening curve. Thus the chemical composition of a steel material is defined as follows.

C: 0.003 to 0.050%

C (Carbon) produces carbide together with other elements by tempering. Particularly, when VC is formed, the yield strength of steel itself increases more than required and a sulfide stress cracking susceptivity increases. Thus, a lower C content is better. However, since excessive time is necessary for refining in a steel making process, an excess reduction of the C content leads to an increase in the steel production cost. Accordingly, the C content is preferably 0.003% or more.

On the other hand, even in a case when C is contained in the steel material, if Ti and/or Zr are additionally contained in the steel material, they are preferentially bonded to C to form TiC and ZrC, which do not lead an increase in yield strength. Thus, the formation of VC can be suppressed. To suppress the formation of VC by Ti or Zr, it is necessary for the C content to be 0.050% or less.

Si: 0.05 to 1.00%

Si (Silicon) is an element necessary as a deoxidizer in steel production. Since a large amount of Si content deteriorates toughness and ductility, smaller C content is better. Nevertheless, an extreme reduction in Si content leads to an increase in the steel making cost. Therefore, the Si content is preferably 0.05% or more. On the other hand, to prevent the deterioration of toughness and ductility, the Si content should be less than 1.00%.

Mn: 0.10 to 1.50%

Mn (Manganese) is also an element necessary as a deoxidizer similar to Si. Further, Mn is an austenite-stabilizing element and also improves the hot workability by suppressing the precipitation of ferrite in hot working. To improve the hot workability, the Mn content should be 0.10% or more. However, since an excessive Mn content deteriorates toughness, the Mn content needs to be 1.5% or less. Further, to enhance pitting resistance and toughness, the Mn content is preferably less than 1.00%.

Cr: 10.5 to 14.0%

Cr (Chromium) is an effective element to enhance corrosion resistance of steel, particularly it is an element that enhances $CO_2$ corrosion resistance. To prevent pitting and gap corrosion, the Cr content should be 10.5% or more. On the other hand, Cr is a ferrite-forming element. When the Cr content exceeds 14.0%, δ ferrite is produced during heating at high temperature, which lowers thermal workability. Since the amount of ferrite is increased, even if tempering is performed in order to improve stress corrosion cracking resistance, the required yield strength cannot be obtained. Therefore, it is necessary for the Cr content to be 14.0% or less.

Ni: 1.5 to 7.0%

Ni (Nickel) is an element to stabilize austenite. If the C content of martensitic stainless steel according to the steel of the present invention is low, the thermal workability is remarkably improved by including Ni in the steel Further, Ni is a necessary element for producing a martensite structure and ensuring necessary yield strength and corrosion resistance. Thus, it is necessary for Ni content to be 1.5% or more. On the other hand, when Ni is excessively added, even if an austenite structure is changed to a martensite structure by cooling from high temperature, a part of the austenite structure remains, which does not provide a stable yield strength and a reduction in corrosion resistance. Accordingly, it is necessary for the Ni content to be 7.0% or less.

V: 0.02 to 0.20%

V (Vanadium) is bonded to C in tempering to form VC. Since VC makes the temper-softening curve steep, it is preferable that the V content is as small as possible. However, since an extreme reduction in the VC content leads to an increase in steel production cost, the V content is preferably 0.02% or more. On the other hand, when the V content exceeds 0.20%, even if Ti and/or Zr are added to the steel having a large C content, C is not consumed and VC is formed. Then, since the hardness after tempering becomes remarkably high, it is necessary for the V content 0.20% or less.

N: 0.003 to 0.070%

N (Nitrogen) has an effect of enhancing the yield strength of steel. When the N content is large, the sulfide stress cracking susceptivity increases and cracking is apt to occur. Further, N is more preferentially bonded to Ti and Zr than C, and might prevent to stable yield strength. Thus the N content needs to be 0.070% or less. When corrosion resistance and stable yield strength is required, the N content is preferable to be 0.010% or less. On the other hand, since the necessary time for refining in a steel making process becomes longer in order to reduce N content, extreme reduction in N content leads to an increase in the steel production cost. Accordingly, it is preferable that the N content is 0.003% or more.

Ti: 0.300% or Less and $([Ti]-3.4\times[N])/[C])>4.5$

Ti (Titanium) is preferentially bonded to C dissolved during tempering to form TiC so that Ti has an effect of suppressing an increase in yield strength as VC is formed. Furthermore, since the variation in the C content leads to a variation in the amount of VC formed by tempering, the variation in the C content is preferably kept at 0.005% or less. However, it is industrially difficult to keep the variation in the C content in a low range so that the C content should be 0.005% or less. Ti has an effect of reducing the variation in the yield strength due to variation of the C content.

Figure 2:
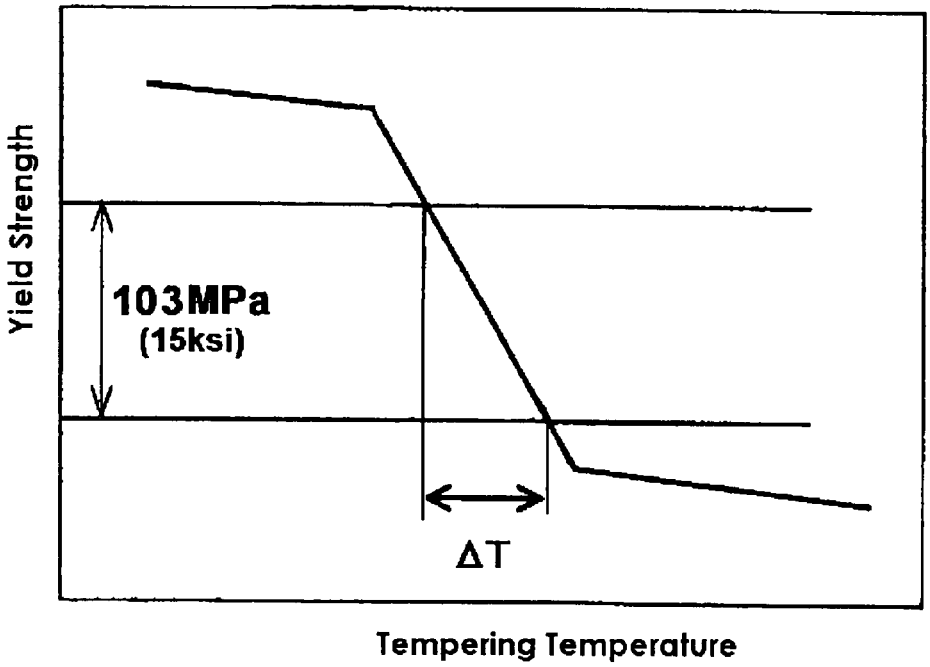
Fig. 2 PRIOR ART
FIG. 2 is a schematically shown temper-softening curve for explaining a tempering temperature range ΔT.

FIG. 2 is a schematically shown temper-softening curve explaining the tempering temperature range ΔT. ΔT is a range of the tempering temperature to satisfy the above-mentioned "API strength specification", that is, a range within the lower limit and the upper limit of yield strength according to the API standard. As shown in FIG. 2, a tempering temperature range ΔT is a temperature range from the lower limit of yield strength in an API specification strength to the upper limit of yield strength obtained by adding 103 MPa to the lower limit, in steep inclination positions.

Taking changes of the furnace temperatures for tempering a martensitic stainless steel into consideration, smaller inclination of the temper softening curve and a wider range of selectable tempering temperatures are preferable to suppress variation in yield strength. That is why a large ΔT is preferable. Changes of temperatures during an actual tempering in a walking beam furnace are about ±10° C. Thus, if ΔT is around 30° C., which is calculated adding 10° C. to 20° C. of a change width of the furnace temperature, the variety of the yield strengths between martensitic stainless steels can be kept within the "API strength specification".

Figure 3:
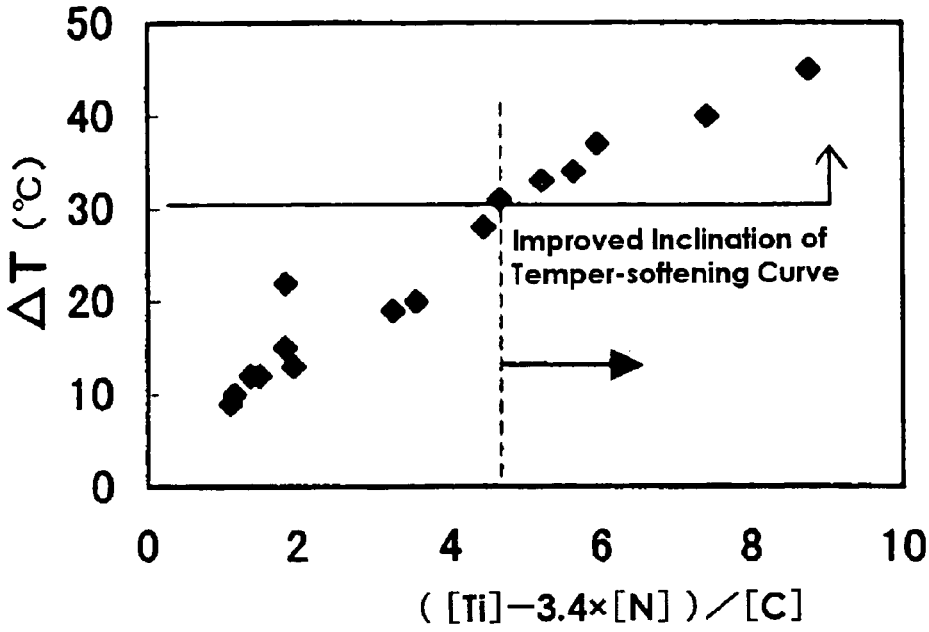
FIG. 3 is a graph showing relationship between ([Ti]−3.4×[N])/[C] and ΔT.

FIG. 3 is a graph showing relationship between $([Ti]-3.4\times[N])/[C]$ and ΔT. $([Ti]-3.4\times[N])/[C]$ means an amount of Ti consumed as carbide after subtracting the Ti consumed as nitride since Ti is bonded to N to form nitride. From FIG. 3, the condition is $([Ti]-3.4\times[N])/[C]>4.5$ in order that ΔT is 30° C. or more. If this condition is satisfied, the problem of variation due to the compositions of steel materials can be solved. On the other hand, since an excessive addition of Ti increases cost, the Ti content is preferably 0.300% or less.

Zr: 0.580% or Less and $([Zr]-6.5\times[N])/[C]>9.0$

Figure 4:
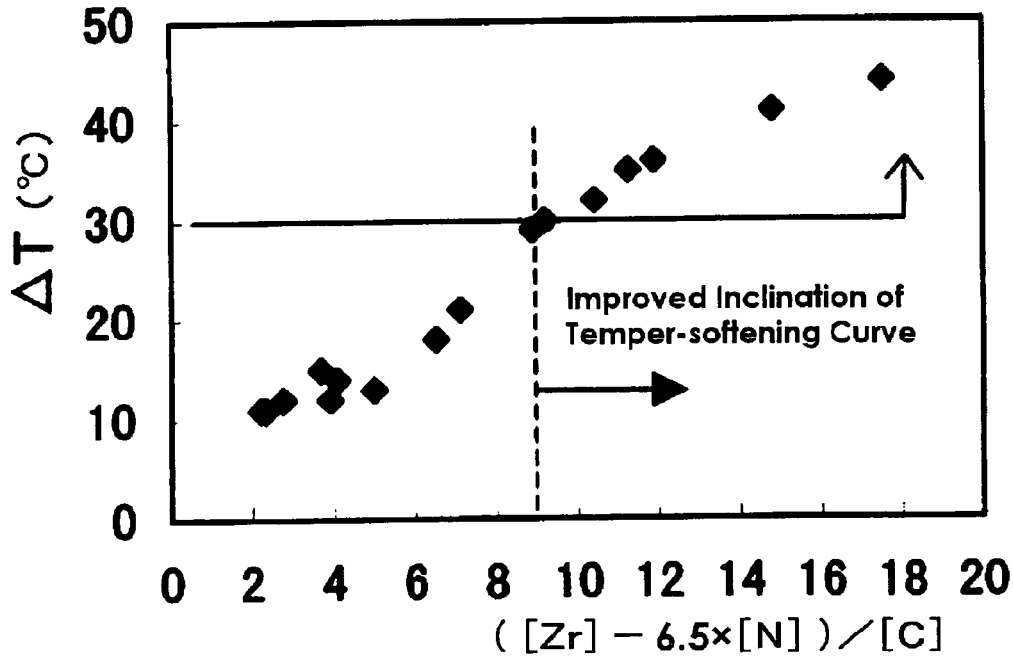
FIG. 4 is a graph showing relationship between ([Zr]−6.5×[N])/[C] and ΔT.

Zr (Zirconium) has the same effect as Ti. FIG. 4 is a graph showing relationship between $([Zr]-6.5\times[N])/[C]$ and ΔT. In FIG. 4, the condition is $([Zr]-6.5\times[N])/[C]>9.0$ in order that the ΔT is 30° C. or more. On the other hand, since an excessive addition of Zr increases cost similar to an excessive addition of Ti, the Zr content is preferably 0.580% or less.

Figure 5:
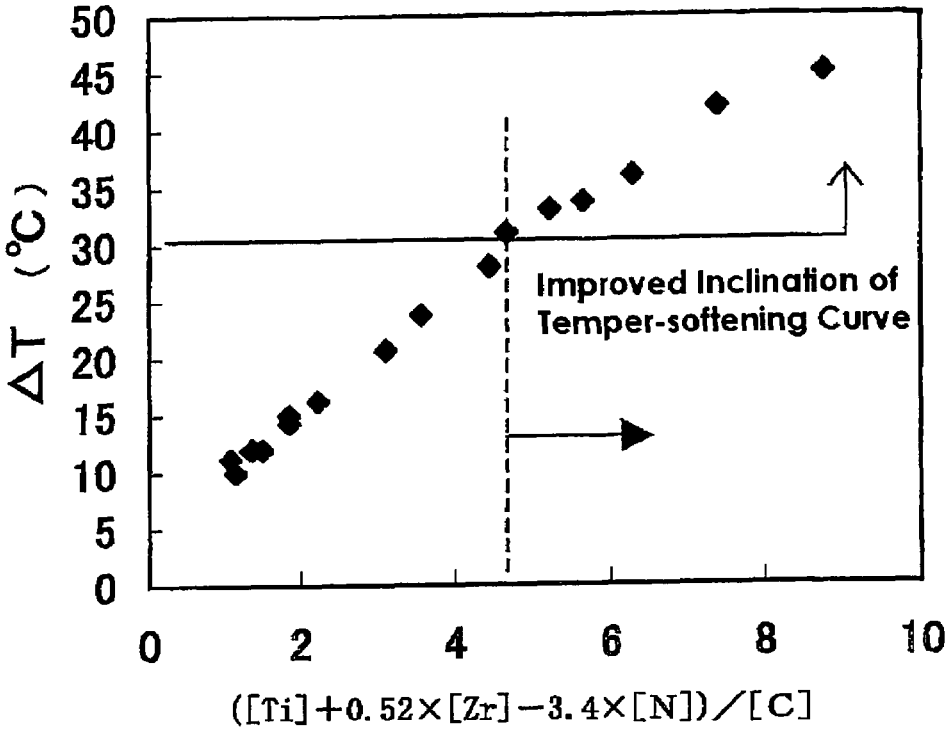
FIG. 5 is a graph showing relationship between ([Ti]+0.52×[Zr]−3.4×[N])/[C] and ΔT.

FIG. 5 is a graph showing relationship between $([Ti]+0.52\times[Zr]-3.4\times[N])/[C]$ and ΔT. As shown in FIG. 5, $([Ti]+0.52\times[Zr]-3.4\times[N])/[C]>4.5$ is preferable in order to allow Ti and Zr to be contained in the steel material. It is noted that, preferably, the Ti content is 0.300% or less and Zr content is 0.580% or less.

Mo: 0.2 to 3.0% or Less

Mo (Molybdenum) could be contained in the steel. If Mo is contained in the steel, it has an effect of enhancing corrosion resistance similar to Cr. Further, Mo has a remarkable effect in the reduction of the sulfide stress cracking susceptivity. To obtain these effects by adding Mo in the steel, the Mo content is preferably 0.2% or more. On the other hand, if Mo content is large, thermal workability is lowered. Accordingly, it is necessary for Mo content 3.0% or less.

The steel includes impurities of P and S. Their contents are controlled up to a specific level as follows:

P: 0.035% or Less

P (Phosphorus) is an impurity element contained in the steel. A large amount of P in the steel causes remarkable steel flaws and remarkably reduces the toughness. Accordingly, the P content is preferably 0.035% or less.

S: 0.010% or Less

S (Sulfur), similar to P, is an impurity element contained in the steel. A large amount of S in the steel remarkably deteriorates the thermal workability and toughness. Accordingly, the S content is preferably to be 0.010% or less.

It is noted that Ca content of not more than 0.0100% (100 ppm) is allowed as an impurity.

(2) Quenching

In the present invention, steel materials having the chemical compositions of (1) above, are heated at 850 to 950° C. and quenched.

If temperature before quenching exceeds 950° C., the toughness deteriorates and the amount of dissolved carbide in the steel increases and free C is increased. Thus Ti and/or Zr do not effectively function, and VC is formed during tempering to increase yield strength. As a result the inclination of the temper-softening curve becomes steep and the variation in yield strength is increased. On the other hand, if the temperature before quenching is lower than 850° C., the dissolution of carbide becomes insufficient and the variation in the yield strength is generated. Further, since uniformity of the structure becomes insufficient, corrosion resistance deteriorates.

Therefore, the temperature before quenching is set at 850 to 950° C. and a fixed time is kept within this temperature range. Then soaking of the steel material is effected and quenching is performed. The quenching process is not particularly limited.

(3) Tempering

As already mentioned regarding API strength specification, steel used for an oil well tube is required to be tempered in order to have a yield strength within a range which is not less than a certain lower limit that is respectively selected within the values of 552 to 759 MPa (80 to 110 ksi) according to each grade of the API standard, and also which is not more than an upper limit that is calculated by adding 103 MPa to the lower limit. However, such a martensitic stainless steel as super 13Cr steel that contains Ni, has a lower $A_{C1}$ point than a martensitic stainless steel such as 13% Cr steel that does not contain Ni, which might lead to an insufficient tempering. Therefore, the super 13Cr steel must be tempered at a temperature of the vicinity of $A_{C1}$ point or over $A_{C1}$ point. As a result, the tempered steel comprises a tempered martensite structure and a retained austenite one, so that the fluctuation of an amount of the retained austenite causes a variation in the yield strength after tempering.

The above-mentioned (1) chemical composition of steel material and (2) quenching are set in order to result in a gentle inclination of the temper softening curve, which reduces the variations in mechanical strengths. However, a gentle inclination of the temper-softening curve cannot always lead to reduce the variations in strengths.

Since the Ni is contained in the steel materials having the above-mentioned chemical compositions such as super 13Cr, the $A_{C1}$ point is lower than the 13% Cr steel. Therefore, the steel such as super 13Cr must be tempered at a temperature between $A_{C1}$−35° C. and $A_{C1}$+35° C. in order to obtain the desired yield strength. The reason is as follows: If the tempering temperature exceeds "$A_{C1}$ point+35° C.", a softening tendency due to austenite transformation is strong and the advance of softening quickly increases, so then it is difficult to give a desired yield strength to martensitic stainless steels. On the other hand, if the tempering temperature is lower than "$A_{C1}$ point−35° C.", the martensitic stainless steel cannot be softened.

When the steel materials, having the chemical compositions described in (1) above, are tempered at such a tempering temperature, not only the softening of martensite structure itself but also the softening of austenite-transformed martensite structure ($A_{C1}$ transformation) are formed. In this case, even if the contents of Ti and/or Zr contained in the steel material are adjusted in order to reduce the variations in the yield strength due to the chemical composition of the steel material, the variations in the yield strengths of tempered martensitic stainless steels are increased by the generation of rapid softening with the passage of time. Therefore, the relationships among yield strength, tempering temperature and tempering time were examined.

Figure 6:
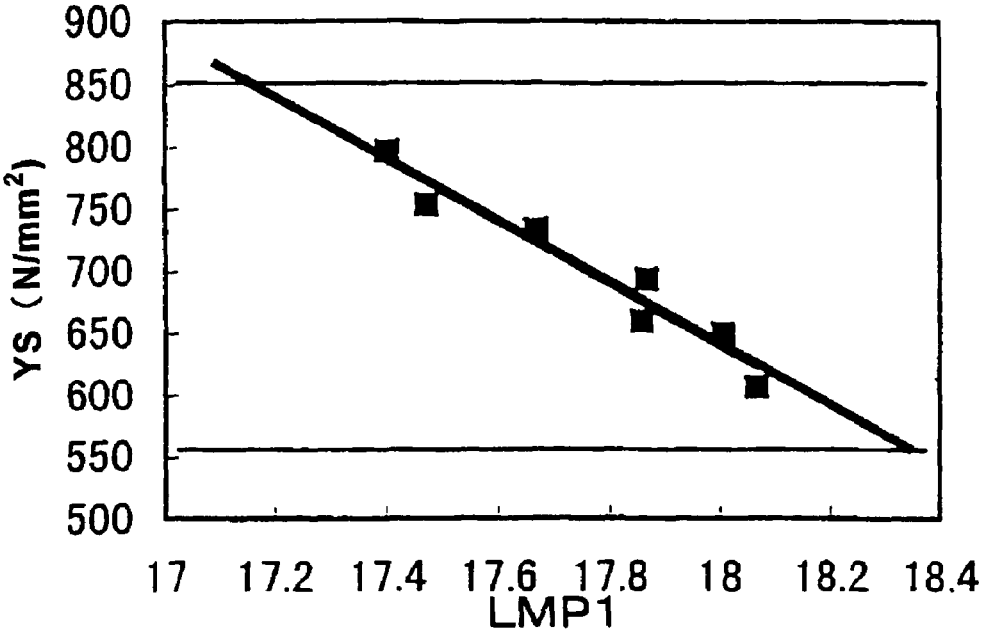
FIG. 6 is a graph showing relationship between softening characteristics LMP1 and yield strength YS.

FIG. 6 is a graph showing relationship between softening characteristics LMP1 and yield strength YS. Here, LMP1 is expressed by:

$$LMP1 = T \times (20 + 1.7 \times \log(t)) \times 10^{-3}$$

wherein T is a tempering temperature (K) and t is a tempering time (hour).

It is apparent from FIG. 6 that there is a specific relationship between LMP1 and YS.

However, in actual operation, as described above, variations of tempering conditions may occur such as a fluctuation in furnace temperature during tempering and a longer period of time in the furnace, which is caused by a difference in the elapsing time between the tempering step and the subsequent step. These facts lead to a generation of a deviation between the designed value of LMP1 and the actual value thereof. Even if a plurality of steel materials are tempered with the same designed value, variations are generated in the actual values of LMP1 by the steel materials, resulting in generation of variations in yield strengths of the martensitic stainless steels.

Figure 7:
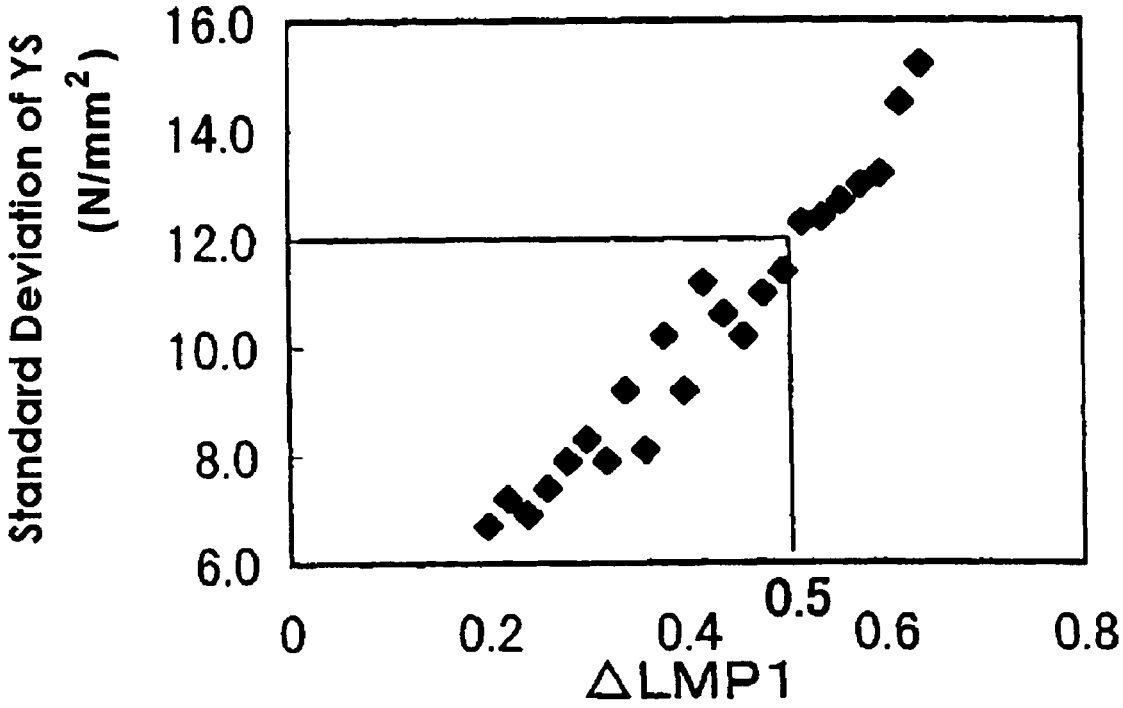
FIG. 7 is a graph showing relationships between ΔLMP1 and standard deviation of yield strength YS.

FIG. 7 is a graph showing the relationships between ΔLMP1 and standard deviation of yield strength YS. ΔLMP1 means a variation in LMP1 obtained when the actual values of LMP1 of the tempered steel materials were measured, which is a value calculated from a difference between the maximum value and the minimum value of the LMP1. FIG. 7 shows that the standard deviation of LMP1 is smaller as ΔLMP1 becomes smaller. Also the variations in yield strength become smaller.

In the present invention, ΔLMP1 is defined as 0.5 or less. Then the standard deviation σ of the variations in the yield strengths is about 12. In this case, since 3σ is about 36, so the variations in yield strength of the produced martensitic stainless steels can be kept within a range of about ⅓ of 103 MPa in the above-mentioned "API strength specification".

EXAMPLE

To confirm the effects of the present invention, 10 test pieces per each condition were produced and the yield strengths (YS) were measured. Then the variations of the yield strengths were examined by calculating their standard deviation. For the test pieces, each of steel tubes or pipes with an outer diameter of 88.9 mm, a wall thickness of 6.45 mm and length of 9600 mm was used.

Tables 1, 2, 3 and 4 respectively show the chemical compositions and the $A_{C1}$ points in their compositions of steel pipes produced as test pieces. The group A of materials, shown in Table 1, is out of the scope of a chemical composition defined by the present invention. Further, the group B of materials, shown in Table 2, is within the scope of a chemical composition defined by the present invention and does not contain substantial amounts of Zr. Further, the group C of materials, shown in Table 3, is within the scope of a chemical composition defined by the present invention and does not contain substantial amount of Ti. Additionally, the group D of materials, shown in Table 4, is within the scope of a chemical composition defined by the present invention and contains substantial amounts of both Ti and Zr.

TABLE 1

| Materials | Chemical Composition (mass %) the balance: Fe and impurities | | | | | | | | | | | | | $A_{C1}$ point |
|---|---|---|---|---|---|---|---|---|---|---|---|---|---|---|
| Group A | C % | Si % | Mn % | Cr % | Ni % | V % | N % | Mo % | Ti % | Zr % | P % | S % | [Ti − 3.4 × N]/C | (° C.) |
| A01 | 0.008 | 0.26 | 0.78 | 12.7 | 5.9 | 0.04 | 0.006 | 2.0 | 0.032 | 0 | 0.014 | 0.001 | 1.45 | 617 |
| A02 | 0.009 | 0.23 | 0.76 | 12.4 | 6.1 | 0.04 | 0.007 | 2.0 | 0.044 | 0 | 0.012 | 0.002 | 2.24 | 611 |
| A03 | 0.008 | 0.27 | 0.75 | 12.3 | 5.9 | 0.05 | 0.006 | 1.9 | 0.045 | 0 | 0.015 | 0.001 | 3.08 | 616 |
| A04 | 0.007 | 0.24 | 0.08 | 12.5 | 6.2 | 0.04 | 0.008 | 2.0 | 0.051 | 0 | 0.017 | 0.001 | 3.40 | 625 |
| A05 | 0.009 | 0.30 | 0.81 | 12.6 | 5.8 | 0.05 | 0.007 | 1.9 | 0.061 | 0 | 0.014 | 0.002 | 4.13 | 618 |
| A06 | 0.010 | 0.26 | 0.79 | 12.3 | 6.0 | 0.04 | 0.009 | 1.9 | 0.074 | 0 | 0.015 | 0.001 | 4.34 | 611 |
| A07 | 0.014 | 0.28 | 0.81 | 12.4 | 5.7 | 0.04 | 0.007 | 2.0 | 0.083 | 0 | 0.014 | 0.001 | 4.23 | 623 |
| A08 | 0.021 | 0.29 | 0.74 | 12.7 | 6.2 | 0.05 | 0.009 | 1.9 | 0.121 | 0 | 0.015 | 0.002 | 4.30 | 608 |
| A09 | 0.026 | 0.23 | 0.89 | 12.9 | 6.1 | 0.04 | 0.011 | 2.1 | 0.143 | 0 | 0.015 | 0.001 | 4.06 | 610 |
| A10 | 0.032 | 0.27 | 0.82 | 12.5 | 6.0 | 0.04 | 0.006 | 2.0 | 0.159 | 0 | 0.016 | 0.001 | 4.33 | 613 |
| A11 | 0.041 | 0.24 | 0.77 | 12.8 | 5.9 | 0.05 | 0.007 | 1.9 | 0.185 | 0 | 0.015 | 0.002 | 3.93 | 615 |
| A12 | 0.044 | 0.26 | 0.72 | 12.3 | 6.0 | 0.04 | 0.008 | 1.9 | 0.210 | 0 | 0.017 | 0.001 | 4.15 | 613 |
| A13 | 0.049 | 0.28 | 0.82 | 12.4 | 5.6 | 0.05 | 0.006 | 2.0 | 0.234 | 0 | 0.015 | 0.002 | 4.36 | 626 |
| A14 | 0.009 | 0.28 | 0.76 | 12.2 | 5.8 | 0.06 | 0.016 | 1.9 | 0.092 | 0 | 0.016 | 0.001 | 4.18 | 620 |
| A15 | 0.008 | 0.27 | 0.78 | 12.4 | 5.6 | 0.04 | 0.023 | 1.9 | 0.113 | 0 | 0.015 | 0.002 | 4.35 | 624 |
| A16 | 0.007 | 0.28 | 0.81 | 12.9 | 5.9 | 0.05 | 0.037 | 2.0 | 0.156 | 0 | 0.014 | 0.002 | 4.31 | 617 |

TABLE 1-continued

| Materials | Chemical Composition (mass %) the balance: Fe and impurities | | | | | | | | | | | | | $A_{C1}$ point |
|---|---|---|---|---|---|---|---|---|---|---|---|---|---|---|
| Group A | C % | Si % | Mn % | Cr % | Ni % | V % | N % | Mo % | Ti % | Zr % | P % | S % | [Ti − 3.4 × N]/C | (° C.) |
| A17 | 0.008 | 0.25 | 0.08 | 12.6 | 5.7 | 0.07 | 0.045 | 2.1 | 0.186 | 0 | 0.016 | 0.001 | 4.13 | 626 |
| A18 | 0.010 | 0.26 | 0.82 | 12.4 | 5.8 | 0.06 | 0.052 | 2.0 | 0.218 | 0 | 0.013 | 0.002 | 4.12 | 620 |
| A19 | 0.011 | 0.23 | 0.79 | 12.3 | 6.0 | 0.05 | 0.063 | 1.9 | 0.261 | 0 | 0.014 | 0.001 | 4.25 | 611 |
| A20 | 0.009 | 0.26 | 0.77 | 12.5 | 6.1 | 0.07 | 0.068 | 2.0 | 0.268 | 0 | 0.016 | 0.002 | 4.09 | 613 |

TABLE 2

| Materials | Chemical Composition (mass %) the balance: Fe and impurities | | | | | | | | | | | | | $A_{C1}$ point |
|---|---|---|---|---|---|---|---|---|---|---|---|---|---|---|
| Group B | C % | Si % | Mn % | Cr % | Ni % | V % | N % | Mo % | Ti % | Zr % | P % | S % | [Ti − 3.4 × N]/C | (° C.) |
| B01 | 0.007 | 0.25 | 0.82 | 12.4 | 5.8 | 0.06 | 0.006 | 2.0 | 0.058 | 0 | 0.014 | 0.001 | 5.37 | 620 |
| B02 | 0.006 | 0.27 | 0.80 | 12.7 | 6.1 | 0.05 | 0.006 | 1.9 | 0.062 | 0 | 0.012 | 0.002 | 6.93 | 609 |
| B03 | 0.008 | 0.24 | 0.77 | 12.6 | 5.9 | 0.06 | 0.005 | 2.0 | 0.083 | 0 | 0.015 | 0.001 | 8.25 | 618 |
| B04 | 0.007 | 0.24 | 0.81 | 12.6 | 5.9 | 0.07 | 0.014 | 1.9 | 0.080 | 0 | 0.012 | 0.001 | 4.63 | 615 |
| B05 | 0.009 | 0.25 | 0.79 | 12.9 | 5.8 | 0.06 | 0.034 | 2.0 | 0.158 | 0 | 0.012 | 0.001 | 4.71 | 621 |
| B06 | 0.008 | 0.27 | 0.80 | 12.8 | 5.7 | 0.05 | 0.053 | 2.0 | 0.219 | 0 | 0.016 | 0.002 | 4.85 | 623 |
| B07 | 0.009 | 0.25 | 0.77 | 12.3 | 5.8 | 0.06 | 0.068 | 1.9 | 0.276 | 0 | 0.017 | 0.001 | 4.98 | 619 |
| B08 | 0.012 | 0.23 | 0.78 | 12.6 | 6.0 | 0.05 | 0.007 | 2.0 | 0.085 | 0 | 0.016 | 0.002 | 5.10 | 614 |
| B09 | 0.016 | 0.24 | 0.79 | 12.9 | 5.7 | 0.07 | 0.008 | 1.9 | 0.110 | 0 | 0.015 | 0.001 | 5.18 | 621 |
| B10 | 0.019 | 0.22 | 0.83 | 12.8 | 6.1 | 0.06 | 0.007 | 2.0 | 0.113 | 0 | 0.013 | 0.002 | 4.69 | 610 |
| B11 | 0.022 | 0.24 | 0.75 | 12.4 | 5.7 | 0.07 | 0.005 | 1.8 | 0.121 | 0 | 0.012 | 0.002 | 4.73 | 620 |
| B12 | 0.027 | 0.28 | 0.80 | 12.5 | 5.9 | 0.04 | 0.006 | 1.9 | 0.152 | 0 | 0.017 | 0.001 | 4.87 | 615 |
| B13 | 0.033 | 0.25 | 0.82 | 12.3 | 6.2 | 0.04 | 0.005 | 2.0 | 0.169 | 0 | 0.018 | 0.001 | 4.61 | 607 |
| B14 | 0.039 | 0.26 | 0.79 | 12.2 | 5.9 | 0.06 | 0.007 | 2.0 | 0.203 | 0 | 0.012 | 0.002 | 4.59 | 618 |
| B15 | 0.043 | 0.24 | 0.78 | 12.7 | 5.8 | 0.07 | 0.008 | 1.9 | 0.231 | 0 | 0.013 | 0.001 | 4.74 | 619 |
| B16 | 0.048 | 0.28 | 0.82 | 12.5 | 6.1 | 0.05 | 0.007 | 2.0 | 0.254 | 0 | 0.016 | 0.002 | 4.80 | 611 |

TABLE 3

| Materials | Chemical Composition (mass %) the balance: Fe and impurities | | | | | | | | | | | | | $A_{C1}$ point |
|---|---|---|---|---|---|---|---|---|---|---|---|---|---|---|
| Group C | C % | Si % | Mn % | Cr % | Ni % | V % | N % | Mo % | Ti % | Zr % | P % | S % | [Zr − 6.5 × N]/C | (° C.) |
| C01 | 0.006 | 0.24 | 0.41 | 12.3 | 6.1 | 0.05 | 0.007 | 0.0 | 0.001 | 0.121 | 0.012 | 0.002 | 12.58 | 570 |
| C02 | 0.006 | 0.26 | 0.48 | 12.2 | 6.0 | 0.06 | 0.007 | 1.9 | 0.001 | 0.128 | 0.012 | 0.002 | 13.75 | 620 |
| C03 | 0.007 | 0.25 | 0.47 | 12.7 | 5.8 | 0.06 | 0.006 | 1.9 | 0.001 | 0.154 | 0.014 | 0.002 | 16.43 | 626 |
| C04 | 0.008 | 0.24 | 0.45 | 12.5 | 5.7 | 0.05 | 0.012 | 2.0 | 0.001 | 0.170 | 0.012 | 0.001 | 11.50 | 631 |
| C05 | 0.006 | 0.27 | 0.47 | 12.7 | 5.9 | 0.07 | 0.029 | 1.9 | 0.001 | 0.309 | 0.011 | 0.003 | 20.08 | 624 |
| C06 | 0.007 | 0.22 | 0.48 | 12.9 | 6.0 | 0.05 | 0.048 | 1.9 | 0.001 | 0.421 | 0.018 | 0.001 | 15.57 | 619 |
| C07 | 0.007 | 0.23 | 0.46 | 12.3 | 6.2 | 0.04 | 0.067 | 2.0 | 0.001 | 0.564 | 0.012 | 0.002 | 18.36 | 615 |
| C08 | 0.011 | 0.27 | 0.42 | 12.7 | 5.5 | 0.06 | 0.008 | 1.9 | 0.001 | 0.186 | 0.018 | 0.001 | 12.18 | 637 |
| C09 | 0.014 | 0.20 | 0.43 | 12.8 | 5.9 | 0.08 | 0.007 | 1.9 | 0.001 | 0.202 | 0.012 | 0.002 | 11.18 | 624 |
| C10 | 0.018 | 0.21 | 0.41 | 12.4 | 6.2 | 0.07 | 0.007 | 2.1 | 0.001 | 0.213 | 0.016 | 0.001 | 9.31 | 620 |
| C11 | 0.021 | 0.23 | 0.39 | 12.7 | 6.1 | 0.06 | 0.007 | 1.9 | 0.001 | 0.256 | 0.017 | 0.003 | 10.02 | 619 |
| C12 | 0.027 | 0.26 | 0.43 | 12.8 | 5.8 | 0.04 | 0.005 | 1.9 | 0.001 | 0.312 | 0.016 | 0.001 | 10.35 | 626 |
| C13 | 0.032 | 0.21 | 0.40 | 12.6 | 5.7 | 0.05 | 0.006 | 1.8 | 0.001 | 0.344 | 0.016 | 0.002 | 9.53 | 627 |
| C14 | 0.038 | 0.20 | 0.47 | 12.7 | 5.8 | 0.07 | 0.006 | 2.0 | 0.001 | 0.412 | 0.015 | 0.002 | 9.82 | 628 |
| C15 | 0.043 | 0.23 | 0.49 | 12.5 | 5.8 | 0.05 | 0.007 | 2.1 | 0.001 | 0.480 | 0.017 | 0.001 | 10.10 | 630 |
| C16 | 0.047 | 0.26 | 0.43 | 12.4 | 5.7 | 0.04 | 0.008 | 0.0 | 0.001 | 0.520 | 0.012 | 0.001 | 9.96 | 582 |

TABLE 4

| Materials | Chemical Composition (mass %) the balance: Fe and impurities | | | | | | | | | | | | | $A_{C1}$ point |
|---|---|---|---|---|---|---|---|---|---|---|---|---|---|---|
| Group D | C % | Si % | Mn % | Cr % | Ni % | V % | N % | Mo % | Ti % | Zr % | P % | S % | [Ti + 0.52 × Zr − 3.4 × N]/C | (° C.) |
| D01 | 0.008 | 0.24 | 0.45 | 12.5 | 5.7 | 0.04 | 0.008 | 1.9 | 0.032 | 0.121 | 0.014 | 0.001 | 8.47 | 628 |
| D02 | 0.007 | 0.26 | 0.43 | 12.7 | 5.6 | 0.05 | 0.007 | 2.0 | 0.034 | 0.092 | 0.013 | 0.002 | 8.29 | 635 |
| D03 | 0.008 | 0.23 | 0.46 | 12.6 | 5.9 | 0.04 | 0.006 | 1.9 | 0.054 | 0.048 | 0.015 | 0.001 | 7.32 | 622 |
| D04 | 0.006 | 0.26 | 0.42 | 12.4 | 6.0 | 0.04 | 0.008 | 2.0 | 0.054 | 0.102 | 0.011 | 0.002 | 13.31 | 623 |
| D05 | 0.007 | 0.24 | 0.43 | 12.6 | 6.1 | 0.05 | 0.007 | 1.9 | 0.056 | 0.115 | 0.013 | 0.001 | 13.14 | 617 |
| D06 | 0.034 | 0.23 | 0.52 | 12.7 | 5.8 | 0.06 | 0.007 | 2.0 | 0.145 | 0.132 | 0.012 | 0.001 | 5.58 | 629 |
| D07 | 0.047 | 0.25 | 0.44 | 12.5 | 5.7 | 0.07 | 0.008 | 0.0 | 0.185 | 0.176 | 0.015 | 0.003 | 5.30 | 583 |

The test pieces having the chemical compositions shown in Tables 1 to 4, heating at 900° C. for 20 minutes and water quenching, were then subjected to tempering treatment. In the tempering treatment, the test pieces were heated to a temperature in the vicinity of the $A_{C1}$ point in a walking beam furnace, kept there for a time, and soaked, then taken out of the furnace and cooled. During the heating of the test pieces in the walking beam furnace, the heating time was appropriately controlled to impart variations in LMP1 in order to differentiate one by one the conditions of the quenching treatment of the 10 steel tubes.

Table 5 describes tempering temperatures and ΔLMP1 of the tempering conditions of T01 to T20 for the test pieces of group A, which are out of the scope of a chemical composition defined in the present invention.

Table 6 describes tempering temperatures and ΔLMP1 of the tempering conditions of T21 to T36 for the test pieces of group B, which are within the scope of a chemical composition defined in the present invention. The ΔLMP1 in Table 6 is a value out of a variation range defined by the present invention.

Table 7 describes tempering temperatures and ΔLMP1 of the tempering conditions of T37 to T52 for the test pieces of group B, which are within the scope of a chemical composition defined in the present invention. The tempering conditions of T37 to T52 in Table 7 satisfy tempering conditions defined in the present invention.

Table 8 describes tempering temperatures and ΔLMP1 of the tempering conditions of T53 to T68 for the test pieces of group C, which are within the scope of a chemical composition defined in the present invention. The tempering conditions of T53 to T68 in Table 8 satisfy tempering conditions defined in the present invention.

Table 9 describes tempering temperatures and ΔLMP1 of the tempering conditions of T69 to T75 for the test pieces of group D is within the scope of a chemical composition defined in the present invention. The tempering conditions of T69 to T75 in Table 9 satisfy the tempering conditions defined in the present invention.

Tempered test pieces were quenched and subjected to tempering treatment at various temperatures in an experimental furnace to obtain temper-softening curves. Then ΔT was confirmed and yield strengths (YS) based on 0.5%-elongation-determination of all test pieces were measured, and a standard deviation of YS was calculated for every tempering condition.

Table 10 describes ΔT and standard deviations of YS in the tempering conditions of T01 to T20. Since the test pieces of group A are out of the scope of a chemical composition defined by the present invention, any ΔT does not attain to 30. As a result the standard deviations of YS showed values of more than 12.

Table 11 describes ΔT and standard deviations of YS in the tempering conditions of T21 to T36. Since the test pieces of group B are within the scope of a chemical composition defined by the present invention, any ΔT is 30 or more. However, since the ΔLMP1 is a value out of a variation range defined by the present invention, the standard deviations of YS showed values of more than 12.

Table 12 describes ΔT and standard deviations of YS in the tempering conditions of T37 to T52. Since the test pieces of group B are within the scope of a chemical composition defined by the present invention and the ΔLMP1 is within a variation range defined in the present invention, any ΔT is 30 or more and the standard deviations of YS showed values of 12 or less.

Table 13 describes ΔT and standard deviations of YS in the tempering conditions of T53 to T68. Since the test pieces of group C are within the scope of a chemical composition defined by the present invention and the ΔLMP1 is within a variation range defined in the present invention, any ΔT is 30 or more and the standard deviations of YS showed values of 12 or less.

Table 14 describes ΔT and standard deviations of YS in the tempering conditions of T69 to T75. Since the test pieces of group Dare within the scope of a chemical composition defined by the present invention and the ΔLMP1 is within a variation range defined in the present invention, any ΔT is 30 or more and the standard deviation of YS shows values of 12 or less.

TABLE 5

| Tempering Condition | Materials | T (° C.) | Δ LMP1 |
|---|---|---|---|
| T01 | A01 | 610 | 0.42 |
| T02 | A02 | 620 | 0.36 |
| T03 | A03 | 630 | 0.42 |
| T04 | A04 | 620 | 0.38 |
| T05 | A05 | 630 | 0.41 |
| T06 | A06 | 630 | 0.37 |
| T07 | A07 | 630 | 0.38 |
| T08 | A08 | 620 | 0.42 |
| T09 | A09 | 630 | 0.44 |
| T10 | A10 | 630 | 0.47 |
| T11 | A11 | 630 | 0.38 |
| T12 | A12 | 630 | 0.39 |
| T13 | A13 | 630 | 0.36 |
| T14 | A14 | 630 | 0.32 |
| T15 | A15 | 630 | 0.33 |
| T16 | A16 | 630 | 0.38 |
| T17 | A17 | 630 | 0.39 |
| T18 | A18 | 630 | 0.42 |
| T19 | A19 | 630 | 0.43 |
| T20 | A20 | 630 | 0.42 |

TABLE 6

| Tempering Condition | Materials | T (° C.) | Δ LMP1 |
|---|---|---|---|
| T21 | B01 | 610 | 0.57 |
| T22 | B02 | 620 | 0.62 |
| T23 | B03 | 630 | 0.63 |
| T24 | B04 | 630 | 0.62 |
| T25 | B05 | 630 | 0.55 |
| T26 | B06 | 630 | 0.56 |
| T27 | B07 | 630 | 0.61 |
| T28 | B08 | 630 | 0.58 |
| T29 | B09 | 630 | 0.59 |
| T30 | B10 | 620 | 0.61 |
| T31 | B11 | 630 | 0.63 |
| T32 | B12 | 630 | 0.56 |
| T33 | B13 | 620 | 0.55 |
| T34 | B14 | 630 | 0.53 |
| T35 | B15 | 610 | 0.62 |
| T36 | B16 | 630 | 0.60 |

TABLE 7

| Tempering Condition | Materials | T (° C.) | Δ LMP1 |
|---|---|---|---|
| T37 | B01 | 610 | 0.45 |
| T38 | B02 | 620 | 0.47 |
| T39 | B03 | 630 | 0.42 |
| T40 | B04 | 630 | 0.42 |
| T41 | B05 | 630 | 0.41 |
| T42 | B06 | 630 | 0.47 |
| T43 | B07 | 630 | 0.44 |
| T44 | B08 | 630 | 0.45 |

TABLE 7-continued

| Tempering Condition | Materials | T (° C.) | Δ LMP1 |
|---|---|---|---|
| T45 | B09 | 630 | 0.48 |
| T46 | B10 | 620 | 0.43 |
| T47 | B11 | 630 | 0.42 |
| T48 | B12 | 630 | 0.43 |
| T49 | B13 | 620 | 0.48 |
| T50 | B14 | 630 | 0.46 |
| T51 | B15 | 630 | 0.43 |
| T52 | B16 | 605 | 0.46 |

TABLE 8

| Tempering Condition | Materials | T (° C.) | Δ LMP1 |
|---|---|---|---|
| T53 | C01 | 605 | 0.45 |
| T54 | C02 | 630 | 0.47 |
| T55 | C03 | 630 | 0.42 |
| T56 | C04 | 630 | 0.42 |
| T57 | C05 | 630 | 0.41 |
| T58 | C06 | 620 | 0.47 |
| T59 | C07 | 620 | 0.44 |
| T60 | C08 | 630 | 0.45 |
| T61 | C09 | 630 | 0.48 |
| T62 | C10 | 630 | 0.43 |
| T63 | C11 | 620 | 0.42 |
| T64 | C12 | 630 | 0.43 |
| T65 | C13 | 630 | 0.48 |
| T66 | C14 | 630 | 0.46 |
| T67 | C15 | 630 | 0.43 |
| T68 | C16 | 610 | 0.46 |

TABLE 9

| Tempering Condition | Materials | T (° C.) | Δ LMP1 |
|---|---|---|---|
| T69 | D01 | 630 | 0.43 |
| T70 | D02 | 630 | 0.47 |
| T71 | D03 | 630 | 0.44 |
| T72 | D04 | 630 | 0.43 |
| T73 | D05 | 620 | 0.41 |
| T74 | D06 | 630 | 0.48 |
| T75 | D16 | 610 | 0.43 |

TABLE 10

| Tempering Condition | Δ T (° C.) | Standard Deviation of YS ($N/mm^2$) |
|---|---|---|
| T01 | 10 | 37.2 |
| T02 | 16 | 24.1 |
| T03 | 19 | 17.6 |
| T04 | 21 | 15.9 |
| T05 | 24 | 13.1 |
| T06 | 26 | 12.4 |
| T07 | 25 | 12.8 |
| T08 | 24 | 12.5 |
| T09 | 24 | 13.3 |
| T10 | 25 | 12.5 |
| T11 | 24 | 13.7 |
| T12 | 23 | 13.0 |
| T13 | 25 | 12.4 |
| T14 | 24 | 12.9 |
| T15 | 26 | 12.4 |
| T16 | 25 | 12.5 |
| T17 | 24 | 13.1 |
| T18 | 23 | 13.1 |
| T19 | 26 | 12.7 |
| T20 | 24 | 13.2 |

TABLE 11

| Tempering Condition | Δ T (° C.) | Standard Deviation of YS ($N/mm^2$) |
|---|---|---|
| T21 | 34 | 13.3 |
| T22 | 39 | 12.2 |
| T23 | 47 | 12.3 |
| T24 | 31 | 14.1 |
| T25 | 33 | 13.7 |
| T26 | 34 | 13.4 |
| T27 | 35 | 13.3 |
| T28 | 36 | 12.9 |
| T29 | 35 | 12.8 |
| T30 | 32 | 13.9 |
| T31 | 33 | 13.9 |
| T32 | 34 | 13.3 |
| T33 | 32 | 13.9 |
| T34 | 32 | 13.9 |
| T35 | 33 | 13.9 |
| T36 | 34 | 13.7 |

TABLE 12

| Tempering Condition | Δ T (° C.) | Standard Deviation of YS ($N/mm^2$) |
|---|---|---|
| T37 | 30 | 10.1 |
| T38 | 39 | 7.8 |
| T39 | 43 | 6.5 |
| T40 | 31 | 11.7 |
| T41 | 33 | 11.5 |
| T42 | 34 | 11.1 |
| T43 | 35 | 10.8 |
| T44 | 36 | 10.6 |
| T45 | 35 | 10.4 |
| T46 | 32 | 11.5 |
| T47 | 33 | 11.4 |
| T48 | 34 | 11.1 |
| T49 | 32 | 11.7 |
| T50 | 32 | 11.8 |
| T51 | 33 | 11.4 |
| T52 | 32 | 11.3 |

TABLE 13

| Tempering Condition | Δ T (° C.) | Standard Deviation of YS ($N/mm^2$) |
|---|---|---|
| T53 | 36 | 8.6 |
| T54 | 38 | 7.9 |
| T55 | 42 | 6.6 |
| T56 | 31 | 9.4 |
| T57 | 48 | 5.4 |
| T58 | 43 | 6.9 |
| T59 | 46 | 5.9 |
| T60 | 37 | 8.9 |
| T61 | 34 | 9.7 |
| T62 | 36 | 11.6 |
| T63 | 32 | 10.8 |
| T64 | 35 | 10.4 |
| T65 | 33 | 11.3 |
| T66 | 34 | 11.0 |
| T67 | 31 | 10.7 |
| T68 | 32 | 10.8 |

TABLE 14

| Tempering Condition | Δ T (° C.) | Standard Deviation of YS ($N/mm^2$) |
|---|---|---|
| T69 | 34 | 6.4 |
| T70 | 32 | 6.5 |
| T71 | 32 | 7.4 |
| T72 | 47 | 4.1 |
| T73 | 51 | 4.1 |
| T74 | 33 | 9.7 |
| T75 | 31 | 10.2 |

As apparent from the above-mentioned descriptions, the method of manufacturing a martensitic stainless steel according to the present invention, can lead to a small variation in the mechanical strengths of the martensitic stainless steels.

INDUSTRIAL APPLICABILITY

In the method of the present invention, a martensitic stainless steel is produced by controlling the chemical composition of a steel material, quenching the steel at an appropriate temperature in order to prevent a steep inclination of a temper-softening curve, and precisely controlling tempering conditions. Accordingly, a variation in the yield strengths of the martensitic stainless steels can be kept small. The steel materials produced by the present invention are very useful for products such as oil well tubes.

The invention claimed is:

1. A method of manufacturing a martensitic stainless steel characterized by comprising the following steps (a) to (d):

(a) preparing steel materials having a chemical composition consisting of, by mass %, C: 0.003 to 0.050%, Si: 0.05 to 1.00%, Mn: 0.10 to 1.50%, Cr: 10.5 to 14.0%, Ni: 1.5 to 7.0%, V: 0.02 to 0.200%, N: 0.003 to 0.070%, Ti: not more than 0.300% and the balance Fe and impurities, and P and S among impurities are not more than 0.035% and not more than 0.010% respectively, and that it also satisfies the following equation:

$$([Ti]-3.4\times[N])/[C]>4.5$$

wherein [C], [N] and [Ti] mean the content (mass %) of C, N and Ti, respectively, (b) heating the steel materials at a temperature between 850 and 950° C., (c) quenching the steel materials, and (d) tempering the steel materials at a tempering temperature between about Ac1 and Ac1+35° C. and in a condition that the value of variation ΔLMP1 of the softening characteristics LMP1 in the steel material is not more than 0.5, so that a standard deviation in yield strength of the tempered steel in the steel material is 12 or less, wherein LMP1 is defined for a respective steel material by the following equation:

$$LMP1=T\times(20+1.7\times\log(t))\times10^{-3}$$

wherein T is a respective actual tempering temperature (K), and t is a tempering time (hour), and LMP1 is controlled based on a difference between a respective actual LMP1 value and a designated LMP1 value.

2. A method of manufacturing a martensitic stainless steel characterized by comprising the following steps (a) to (d):

(a) preparing steel materials having a chemical composition consisting of, by mass %, C: 0.003 to 0.050%, Si: 0.05 to 1.00%, Mn: 0.10 to 1.50%, Cr: 10.5 to 14.0%, Ni: 1.5 to 7.0%, V: 0.02 to 0.20%, N: 0.003 to 0.070%, Ti: not more than 0.300%, Mo: 0.2 to 3.0%, and the balance Fe and impurities, and P and S among impurities are not more than 0.035% and not more than 0.010% respectively, and that it also satisfies the following equation:

$$([Ti]-3.4[N])/[C]>4.5$$

wherein [C], [N] and [Ti] mean the content (mass %) of C, N and Ti, respectively, (b) heating the steel materials at a temperature between 850 and 950° C., (c) quenching the steel materials, and (d) tempering the steel materials at a tempering temperature between about $Ac_1$ and $Ac_1$+35° C. and in a condition that the value of variation ΔLMP1 of the softening characteristics LMP1 in the steel materials is not more than 0.5, so that a standard deviation in yield strength of the tempered steel in the steel material is 12 or less, wherein LMP1 is defined for a respective steel material by the following equation:

$$LMP1=T(20+1.7\times\log(t))10^{-3}$$

wherein T is a respective actual tempering temperature (K), and t is a respective tempering time (hour), and LMP1 is controlled based on the difference between a respective actual LMP1 value and a designated LMP1 value.

* * * * *

UNITED STATES PATENT AND TRADEMARK OFFICE

CERTIFICATE OF CORRECTION

PATENT NO. : 7,704,338 B2
APPLICATION NO. : 10/942132
DATED : April 27, 2010
INVENTOR(S) : Tanida It is certified that error appears in the above-identified patent and that said Letters Patent is hereby corrected as shown below:

Column 17, line 35
"1.5 to 7.0%, V: 0.02 to 0.200%, N: 0.003 to 0.070%, Ti:"
Should read
"1.5 to 7.0%, V: 0.02 to 0.20%, N: 0.003 to 0.070%, Ti:"

Signed and Sealed this
Twenty-sixth Day of April, 2011

David J. Kappos

David J. Kappos
*Director of the United States Patent and Trademark Office*